US009068783B2

(12) United States Patent
Bal

(10) Patent No.: US 9,068,783 B2
(45) Date of Patent: Jun. 30, 2015

(54) TUBE HEAT EXCHANGER

(75) Inventor: Guido Jan Bal, Wilrijk (BE)

(73) Assignee: ATLAS COPCO AIRPOWER N.V., Wilrijk (BE)

( * ) Notice: Subject to any disclaimer, the term of this patent is extended or adjusted under 35 U.S.C. 154(b) by 374 days.

(21) Appl. No.: 13/497,659

(22) PCT Filed: Sep. 16, 2010

(86) PCT No.: PCT/BE2010/000065
§ 371 (c)(1),
(2), (4) Date: Mar. 22, 2012

(87) PCT Pub. No.: WO2011/035396
PCT Pub. Date: Mar. 31, 2011

(65) Prior Publication Data

US 2012/0199325 A1 Aug. 9, 2012

(30) Foreign Application Priority Data

Sep. 23, 2009 (BE) ..... 2009/0585

(51) Int. Cl.
*F28D 7/00* (2006.01)
*F28D 7/16* (2006.01)
*F28F 9/22* (2006.01)

(52) U.S. Cl.
CPC ... *F28D 7/16* (2013.01); *F28F 9/22* (2013.01); *F28F 2275/085* (2013.01); *F28F 2009/226* (2013.01)

(58) Field of Classification Search
CPC ..... F28D 7/16; F28F 9/22; F28F 2275/085; F28F 2009/226
USPC ..... 165/159, 161, 162
See application file for complete search history.

(56) References Cited

U.S. PATENT DOCUMENTS

| | | | | |
|---|---|---|---|---|
| 4,778,005 | A * | 10/1988 | Smith | 165/160 |
| 5,447,195 | A | 9/1995 | Luyts | |
| 7,610,953 | B2 * | 11/2009 | Mulder | 165/160 |
| 8,453,721 | B2 * | 6/2013 | Mathur et al. | 165/157 |
| 2003/0116306 | A1 * | 6/2003 | Besik | 165/109.1 |

(Continued)

FOREIGN PATENT DOCUMENTS

| | | | |
|---|---|---|---|
| BE | 756193 | A | 2/1971 |
| CN | 1752708 | A | 3/2006 |

(Continued)

OTHER PUBLICATIONS

International Search Report in PCT/BE2010/000065, Aug. 18, 2011.

(Continued)

*Primary Examiner* — Mohammad M Ali
*Assistant Examiner* — Raheena Rehman
(74) *Attorney, Agent, or Firm* — Bacon & Thomas, PLLC

(57) ABSTRACT

Tube heat exchanger for exchanging heat between first and second fluids includes a housing wherein one or more tubes extend between an inlet part and an outlet part for the first fluid. The tubes extend through passages through baffle plates which are secured at a distance from one another by means of one or more fastening devices that include a profile that is snapped in place in one or more recesses in the respective baffle plates. The profile is a V-profile and the recess is a V-shaped recess having protrusions on its two opposite edges behind which the V-profile is snapped in place.

12 Claims, 4 Drawing Sheets

(56) References Cited

U.S. PATENT DOCUMENTS

Figure 1:
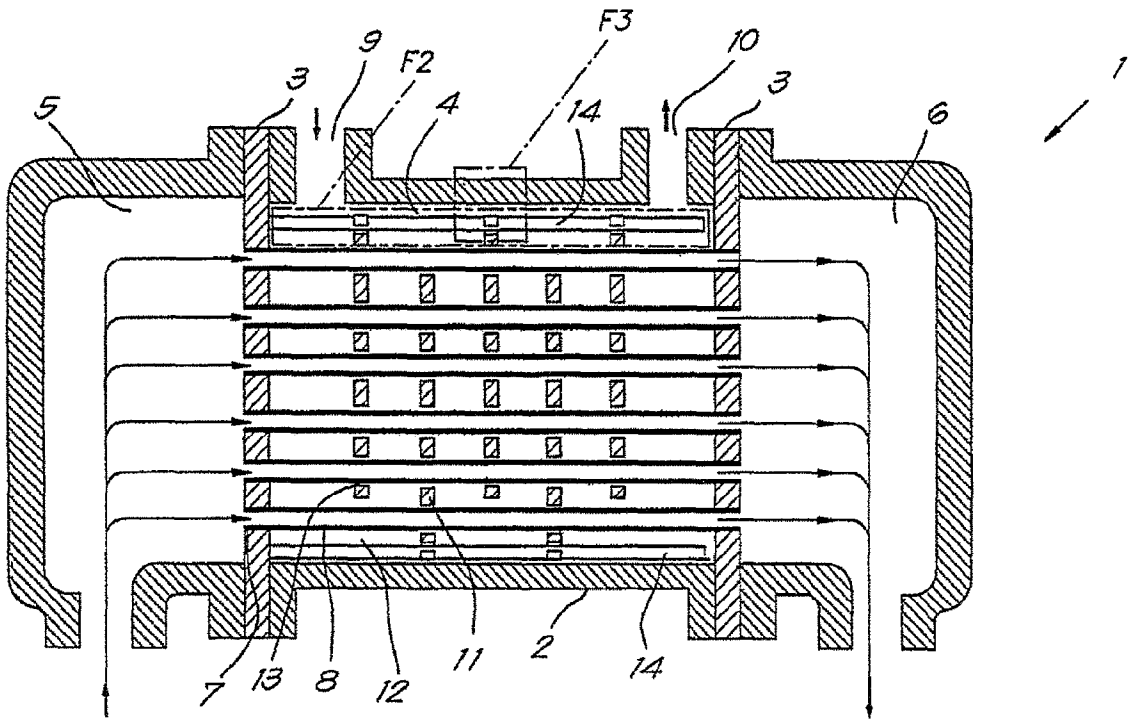

| | | | | |
|---|---|---|---|---|
| 2003/0131977 | A1* | 7/2003 | West | 165/159 |
| 2005/0160722 | A1* | 7/2005 | Shih et al. | 60/288 |
| 2007/0107886 | A1* | 5/2007 | Chen | 165/161 |

FOREIGN PATENT DOCUMENTS

| | | | |
|---|---|---|---|
| CN | 101196382 | A | 6/2008 |
| DE | 2657666 | A1 | 12/1977 |
| DE | 2713257 | A1 * | 9/1978 |
| DE | 2713257 | A1 | 9/1978 |
| EP | 0628779 | A2 | 12/1994 |
| FR | 8203300 | A1 | 9/1983 |
| GB | 2070758 | A | 9/1981 |

OTHER PUBLICATIONS

IPRP in PCT/BE2010/000065, Feb. 28, 2012.
Chinese Office Action dated Jun. 27, 2013, for CN 201080042421.0, and English translation thereof.

* cited by examiner

TUBE HEAT EXCHANGER

The present invention relates to a tube heat exchanger.

There are already known tube heat exchangers for exchanging heat between two fluids, a first and .a second fluid respectively, whereby the heat exchanger is composed of a housing wherein one or more tubes extend which are secured at their ends to partitions dividing the housing into three compartments, more particularly an inlet compartment and an outlet compartment for the first fluid, and between them a central compartment with its own inlet and outlet for the second fluid.

In conventional heat exchangers one or more baffle plates are placed transversely to the direction of the tubes and the tubes extend through passages in these baffle plates in order to guide the flow of the second fluid according to a certain pattern.

Traditionally the baffle plates are arranged such that a passage is left for the second fluid, alternately on the one side and the opposite side of the housing, in order to lead the second fluid along a certain pattern.

In known tube heat exchangers, the baffle plates are kept at a distance from one another by means of fastening means in the form of spacer bushes or spacer plates that are placed between the baffle plates.

In the case of spacer bushes at least one threaded rod is provided through each series of aligned spacer bushes, such that these threaded rods also extend through the respective passages in the baffle plates.

A disadvantage of such a conventional embodiment is that the threaded rods and spacer bushes have to be constructed from a sufficiently thick material, as the movement of the baffle plates, as a result of the flow of the second fluid through the central compartment, must be limited.

The large quantity of material needed obviously implies high material costs.

A further disadvantage is that the installation of the baffle plates is laborious, such that the assembly of the tube heat exchanger is labour intensive and expensive.

Moreover the threaded rods must be fastened.

A further disadvantage is that different materials are used for the threaded rods and spacer bushes than for the material of which the baffle plates are made, which brings about higher logistical costs.

The purpose of the present invention is to provide a solution to one or more of the above-mentioned and/or other disadvantages, by providing a tube heat exchanger for exchanging heat between two fluids, a first and second fluid respectively, consisting of a housing wherein one or more tubes extend between an inlet part and an outlet part for the first fluid, and whereby these tubes extend through passages through baffle plates which are kept at a distance from one another by means of one or more fastening means, whereby the fastening means are formed of a profile that is snapped in place in recesses in the respective baffle plates, and whereby the above-mentioned fastening means are constructed in the shape of a V-profile and the recesses have a matching V-shape, and the edges of the recesses in the baffle plates are provided with protrusions.

An advantage of such a tube heat exchanger according to the invention is that the use of such a profile enables easy assembly of the baffle plates in the housing.

After all it is sufficient to place the baffle plates at correct distances from one another, for example in a mounting jig suitable for this purpose, after which the fastening means can be easily fastened by being snapped in place to secure the baffle plates at a distance from one another.

Another advantage is that resiliency can be obtained from the profile, for example by a thin-walled construction of this profile, which leads to a material saving and thus a cost saving.

A further advantage is that the fastening means and the baffle can be made from the same material, which reduces the logistics required for the assembly of the tube heat exchanger according to the invention.

Preferably the recesses are placed along the periphery of the baffle plates, such that the profile can be easily clicked in place in a radial direction.

The above-mentioned protrusions act as locking elements behind which the V profile can be snapped in place.

An additional advantage of the use of a V-profile is that, due to the V-shape, the lateral stiffness of the fastening means is increased with respect to the known threaded rods, such that this V-profile can withstand high pressure forces without bending.

Preferably slots are placed in the profile in which the above-mentioned protrusions can be held during assembly, such that the baffle plates can be secured in these slots at a distance from one another.

The invention also relates to a baffle plate for a tube heat exchanger whereby this baffle plate shows the specific characteristic that it comprises at least one recess for snapping a profile in place that forms part of a fastening means for keeping baffle plates at a distance in a tube heat exchanger.

Figure 2:
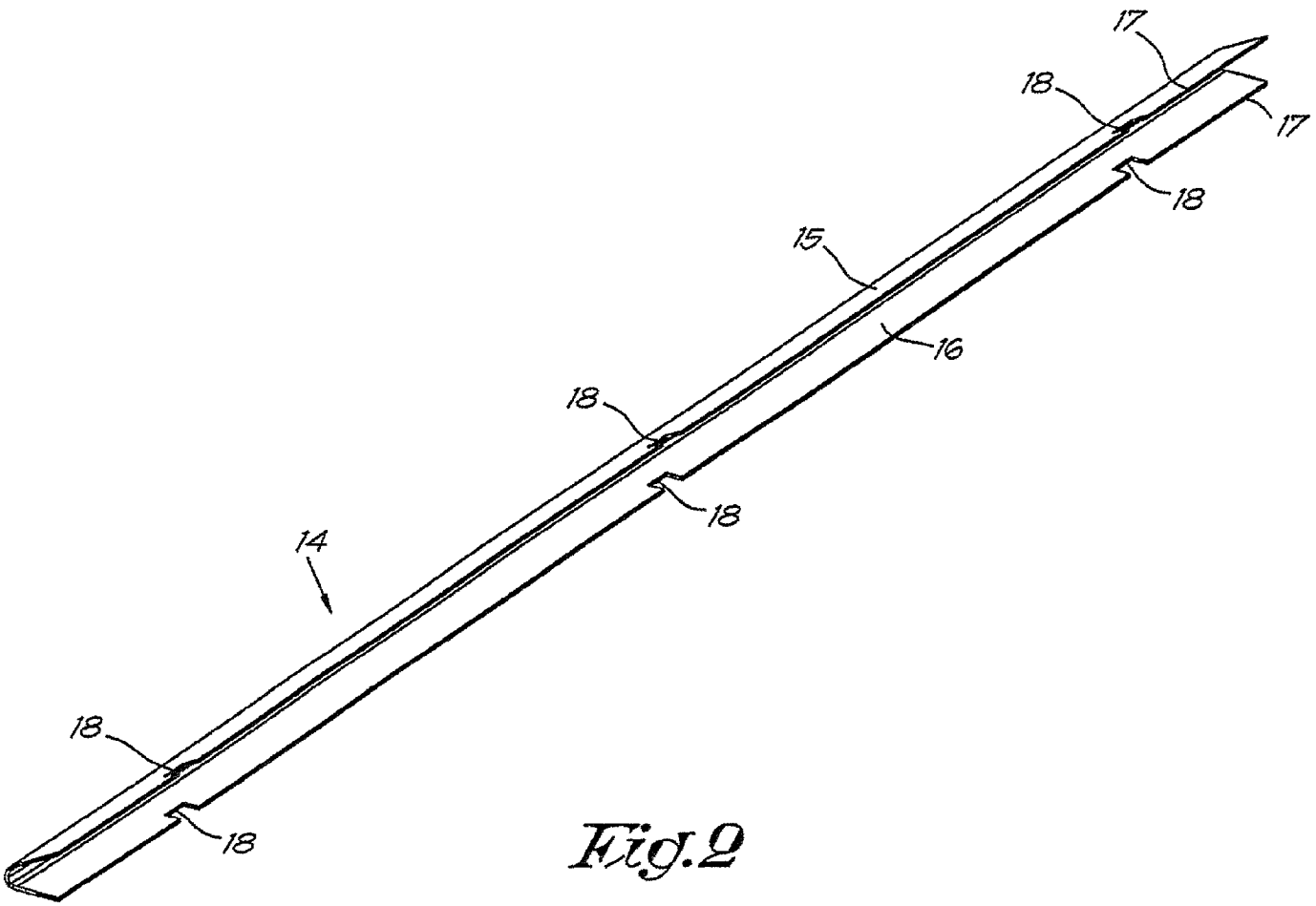
Figure 3:
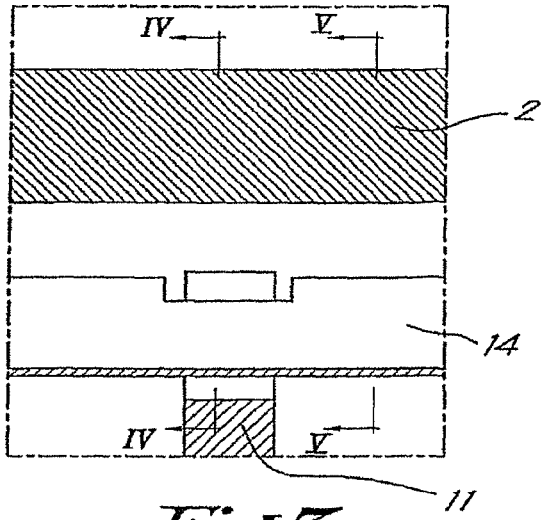
Figure 4:
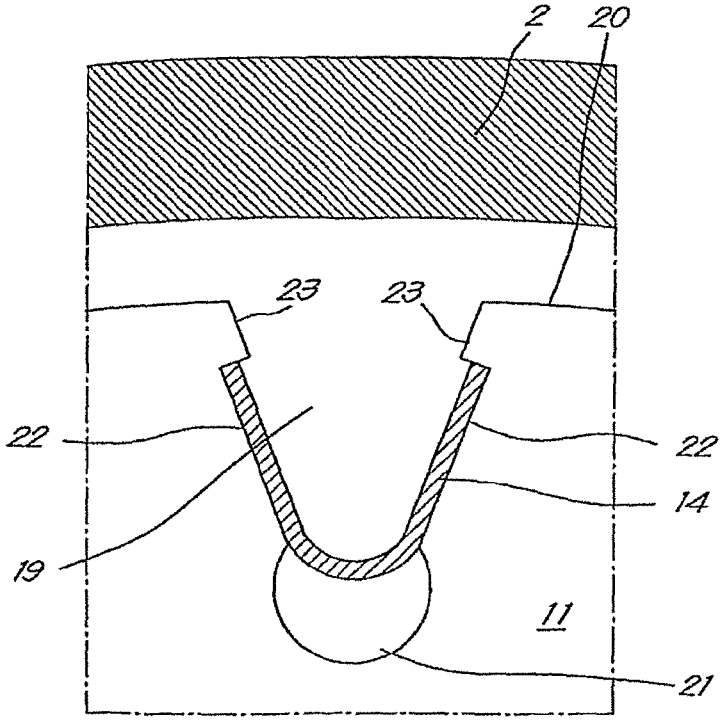
Figure 5:
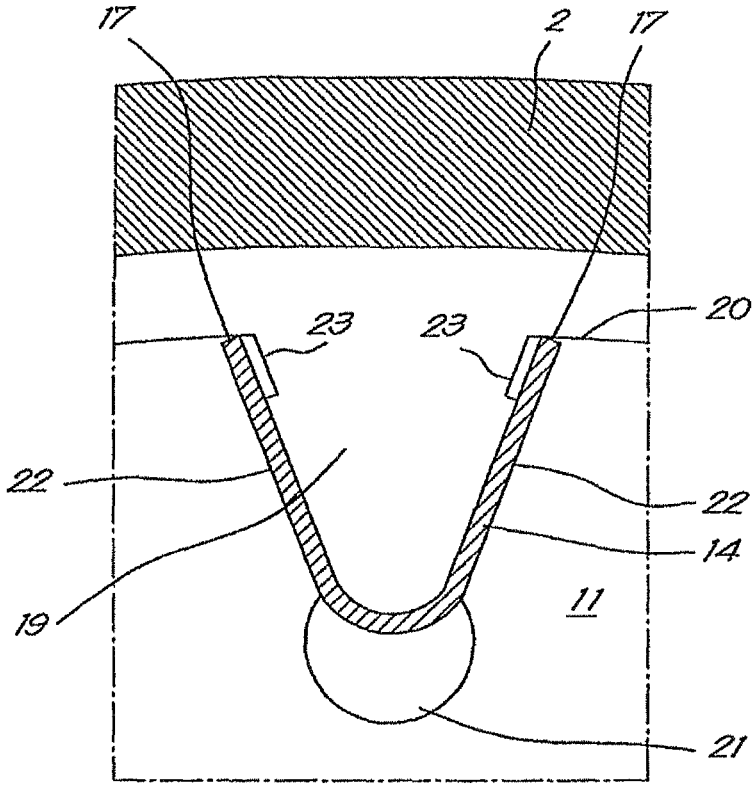

In order to better show the characteristics of the invention, a preferred embodiment of a tube heat exchanger according to the invention is described below, as an example without any limiting nature, with reference being made to the accompanying drawings, in which:

FIG. 1 schematically shows a cross-section of a tube heat exchanger according to the invention;

FIG. 2 schematically shows in perspective a preferred embodiment of the fastening means that are designated with F2 in FIG. 1;

FIG. 3 shows the part designated with F3 in FIG. 1 on a larger scale; and FIGS. 4 and 5 show, cross-sections, on a larger scale, respectively according to the line IV-IV and line V-V in FIG. 3.

FIG. 1 schematically shows a tube heat exchanger 1 according to the invention which primarily comprises a closed housing 2 which is divided, into three compartments 4 to 6, i.e. a central compartment 4 and two compartments 5 and 6 on either side of it, by means of end pieces in the shape of two parallel partition plates 3.

The central compartment 4 is situated between said partition plates 3, and passages 7 are provided in said partition plates 3, through which passages 7 parallel tubes 8 extend.

The above-mentioned tubes 8 form a connection between the two other compartments 5 and 6 on either side of the central compartment 4, more particularly compartment 5 which forms an inlet part for a first fluid, and compartment 6 forming an outlet part for this first fluid.

The central compartment 4 has an inlet 9 and an outlet 10 for a second fluid, and baffle plates 11 which are oriented almost transversally to the longitudinal direction of the tubes 8.

The form and relative position of the baffle plates 11 is chosen such that a certain flow pattern is imposed on the second fluid, such as a zigzag pattern, for example, whereby the second fluid flows through the central compartment in a back and forth movement in a number of passes, such that the unity of the fluid increases, such that the heat transfer can also increase.

To this end the baffle plates 11 extend from one side of the central compartment 4 up to a certain distance from the other side of the central compartment 4, to form a passage 12 with a change of direction for the second fluid, and this in a way such that the successive passages 12 are alternately on the one side or the other.

The baffle plates 11 are preferably made from stainless steel, but the invention is not in any way limited to this.

The above-mentioned baffle plates 11 show passages 13 through which the tubes 8 of the heat exchanger 1 go.

The above-mentioned passages 13 have a diameter which practically matches the diameter of the tubes 8, such that there is limited clearance between the baffle plate 11 and the tubes 8.

According to the invention the baffle plates 11 are held at a distance from one another by means of one or more fastening means, whereby each fastening means is formed of a profile 14, preferably made from a resilient material.

The fastening means are constructed in the form of a V-profile 14, as shown in FIG. 2, with two walls 15 and 16 tapering towards one another.

Preferably, one or more slots 18 are provided opposite to one another at the free edges 17 of these walls 15 and 16, which, in the embodiment of FIG. 2, present a width, and which extend transversely into the above-mentioned free edges 17.

Preferably the baffle plates 11 are kept in place as the V-profile 14 is snapped in place in the V-shaped recesses 19 which are located along the periphery of the baffle plates 11, during assembly of the tube heat exchanger according to the invention.

The recess 19 in the baffle plate 11 is practically V-shaped, such that both the point of the V-shaped recess 19, and the closed side of the fastening profile are directed away from the peripheral edge 20 of the baffle plate 11.

According to a preferred characteristic of the invention, the bottom of the recess 19 is extended by an additional opening 21, such that no sharp arrow-shaped V-recesses 19 are formed.

The tapering edges 22 of the recess 19 show protrusions 23, and preferably have dimensions matching or being somewhat smaller than the dimensions of the slots in the profile 14.

It is clear that, for the realisation of the tube heat exchanger according to the invention, it is sufficient to place the baffle plates 11 at the correct distances with respect to one another, for example in a mounting jig provided for this purpose, and to ensure that the recesses 19 in the baffle plates 11 are all in line with one another.

Subsequently, the V-profile can be snapped in place in the recesses 19 of the baffle plates 11.

It is clear that, among others by using a resilient material for the construction of the fastening means, it can be ensured that these fastening means can easily be clicked into the baffle plates 11 by a snap fit.

When securing the baffle plates 11 into the profile 14, the edges 22 of the V-shaped recess 19 and the profile 14 are brought into contact with each another.

The profile 14 snaps into place as the protrusions 23 on the edges 22 of the recesses 19 are held in the slots 18 of the profile.

Preferably the free edges 17 of the V-shaped profile 14 in this assembled state extend up to the peripheral edge 20, as shown in the cross-sections of FIGS. 4 and 5, or practically up to the peripheral edge 20 of the baffle plates 11.

To close, if necessary the securing profile 14 with the snapped-in baffle plates 11 can be simply secured to a partition 3, for example, by means of a suitable technique such as welding or the like.

The use of the tube heat exchanger 1 according to the invention is analogous to the use of known tube heat exchangers.

A first fluid flows from the inlet part 5 to the outlet part 6 through the tubes 8.

The second fluid is led through the central compartment 4 via the inlet 9 and is guided by the baffle plates 11 according to a zigzag pattern over the tubes 8.

Due to the contact between the second fluid and the tubes 8, through which the first fluid flows, heat is transferred such that the temperatures of, the second fluid at the outlet 10 and the inlet 9 will be different.

In an alternative embodiment of the invention, the inlet 9 and outlet 10 of the second fluid are located diagonally opposite to one another, instead of on the same side as in the embodiment of FIG. 1.

It is not ruled out either that the compartments 5 and 6 are on the same side of the central compartment 4, in which case, as is known, there will be a return space on the other side of this central compartment 4.

It will be clear to a man skilled in the art that the tubes 8 can have fins to increase the heat exchange between the first and second fluid.

It is of course not ruled out according to the invention that the heat exchanger 1 is of a multipartite construction.

Although the embodiment of the invention described here shows a thin-walled, open V-profile 14, it is obvious that alternative embodiments are possible, for example where the securing profile is a closed profile, such. as for example a thin-walled cylindrical profile, a triangular or square profile.

Moreover it is not ruled out that the recesses 19 in the baffle plates 11 are not on the periphery of the baffle plates 11, but at a certain distance from the peripheral edge 20.

The present invention, is hot in any way limited to the embodiment described as an example and shown in the drawings, but a tube heat exchanger and baffle plate according to the invention can be realised in all kinds of shapes and dimensions, without departure from the scope of the invention.

The invention claimed is:

1. A tube heat exchanger for exchanging heat between two fluids, including a first and second fluid, comprising of a housing having one or more tubes extending between an inlet part and an outlet part for the first fluid, and a pair of partition plates defining a central compartment between the inlet part and the outlet part, wherein the tubes extend through passages through baffle plates which extend from a side of the central compartment up to a distance spaced apart from an opposite side of the central compartment in an alternating manner to define a flow pattern imposed on the second fluid, and wherein the baffle plates are secured at a distance from one another by one or more fastening devices, said fastening devices comprising a profile that is snapped in place in one or more recesses in the respective baffle plates, wherein the profile is a V-profile and the recess is a V-shaped recess having an open end with protrusions on two opposite edges thereof, behind which protrusions the V-profile is snapped in place.

2. The tube heat exchanger according to claim 1, wherein the open end of the recesses in the baffle plates are located along a periphery of the baffle plates.

3. The tube heat exchanger according to claim 1, wherein the profile, at a point where the baffle plates are secured, is provided with a slot wherein said protrusions of the V-shaped recess are held in the assembled state of the baffle plates.

4. The tube heat exchanger according to claim 1, wherein a closed side of the V-profile and a point of the V-shaped recess of the peripheral edges of the respective baffle plates are directed away.

5. The tube heat exchanger according to claim 1, wherein free edges of the V-shaped profile, in the assembled state, extend up to a peripheral edge of the baffle plates.

6. The tube heat exchanger according to claim 1, wherein the tubes provide a fluid passageway from the inlet part to the outlet part.

7. The tube heat exchanger according to claim 1, wherein the central compartment includes an inlet and an outlet for the second fluid.

8. The tube heat exchanger according to claim 7, wherein the inlet and the outlet for the second fluid are located on the same side of the housing.

9. The tube heat exchanger according to claim 7, wherein the inlet and the outlet for the second fluid are located diagonally opposite to one another.

10. The tube heat exchanger according to claim 1, wherein the alternating manner of the baffle plates defines a zigzag pattern for the flow of the second fluid.

11. In combination, a plurality of baffle plates for a tube heat exchanger and fastening devices arranged to keep the baffle plates at a distance from one another in the tube heat exchanger, said baffle plates having at least one recess having an open end for snap-fitting a profile which comprises part of a respective fastening device, and wherein each said fastening devices each comprising a V-shaped profile that is snappable in place behind a respective protrusion, within a respective recess of the baffle plates.

12. The combination according to claim 11, wherein said open end of the recess is located along a periphery of the baffle.

* * * * *